US007458524B2

(12) United States Patent
Prieto et al.

(10) Patent No.: US 7,458,524 B2
(45) Date of Patent: Dec. 2, 2008

(54) SPRAY NOZZLE WITH ALIGNMENT KEY

(75) Inventors: Vincent A. Prieto, Lorain, OH (US); Deborah Kosovich, Grafton, OH (US)

(73) Assignee: Nordson Corporation, Westlake, OH (US)

( * ) Notice: Subject to any disclaimer, the term of this patent is extended or adjusted under 35 U.S.C. 154(b) by 590 days.

(21) Appl. No.: 11/131,630

(22) Filed: May 18, 2005

(65) Prior Publication Data

US 2005/0263620 A1 Dec. 1, 2005

Related U.S. Application Data

(60) Provisional application No. 60/574,107, filed on May 25, 2004.

(51) Int. Cl.
*B05B 1/00* (2006.01)
*B05B 15/00* (2006.01)

(52) U.S. Cl. ..... 239/71; 239/597; 239/600

(58) Field of Classification Search ..... 239/71, 239/390, 465, 580, 597–602
See application file for complete search history.

(56) References Cited

U.S. PATENT DOCUMENTS

| | | | | |
|---|---|---|---|---|
| 3,658,257 | A | 4/1972 | Rood | |
| 3,697,393 | A | 10/1972 | Stumphauzer et al. | |
| 3,737,108 | A | 6/1973 | Stumphauzer et al. | |
| 3,819,403 | A | 6/1974 | Hogstrom | |
| 4,141,503 | A * | 2/1979 | Beck | 239/394 |
| 4,527,745 | A * | 7/1985 | Butterfield et al. | 239/600 |
| 4,717,077 | A * | 1/1988 | Takata | 239/548 |
| 4,884,742 | A | 12/1989 | Bekius et al. | |
| 5,060,869 | A | 10/1991 | Bekius et al. | |
| 5,078,325 | A | 1/1992 | Waryu et al. | |
| 5,096,746 | A | 3/1992 | Strizki | |
| 5,255,848 | A * | 10/1993 | Rhodehouse | 239/119 |
| 5,337,958 | A * | 8/1994 | Hennessy et al. | 239/71 |
| 5,494,226 | A | 2/1996 | Herstek et al. | |
| 5,941,463 | A | 8/1999 | Herstek et al. | |
| 6,742,730 | B2 | 6/2004 | Kassanits | |
| 2002/0014541 | A1 * | 2/2002 | Krohn et al. | 239/119 |
| 2002/0053613 | A1 | 5/2002 | Kassanits | |
| 2005/0127212 | A1 | 6/2005 | Kassanits | |

OTHER PUBLICATIONS

"A7A Airless Spray Gun Nozzle Locator Kit", pp. E6.3-E6.4, dated Feb. 1992.

Blank Adapter Nozzle, drawing for Part No. 028078, dated Sep. 1968.

Adapter DH Nozzle Press In, drawing for Part No. 109346, dated Sep. 1988.

Partial International Search Report from PCT/US2005/017259.

* cited by examiner

*Primary Examiner*—Darren W Gorman
(74) *Attorney, Agent, or Firm*—Calfee, Halter & Griswold LLP

(57) ABSTRACT

A spray nozzle assembly includes a nozzle tip and a nozzle tip holder. The holder can be rotationally adjusted so as to change the spray pattern orientation for a nozzle tip that produces an asymmetrical spray pattern. The nozzle holder includes a keyway feature such as different sized holes that provide an indication to the operator of the nozzle pattern orientation. The holes may also be used in combination with a tool or key that allows the nozzle holder to be adjusted for a particular spray pattern orientation. The tool may optionally include a feature that indicates to an operator the spray pattern orientation. The nozzle holder may also include a recess for retaining the nozzle tip at an angle relative to an axis of the holder.

23 Claims, 4 Drawing Sheets

SPRAY NOZZLE WITH ALIGNMENT KEY

RELATED APPLICATIONS

This application claims the benefit of U.S. provisional patent application Ser. No. 60/574,107 filed on May 25, 2004 for NOZZLE KEY, the entire disclosure of which is fully incorporated herein by reference.

TECHNICAL FIELD OF THE INVENTION

The invention relates generally to material application apparatus such as used for spraying paints, lacquers, conformal coating and other materials. More particularly, the invention relates to a spray nozzle used with such apparatus.

BACKGROUND OF THE INVENTION

Material application systems are commonly used for applying liquid and powder material to an object, part or other surface. Due to the wide variety of materials that can be applied, there is also a wide variety of spray nozzle assembly designs. A spray nozzle assembly is used generally to atomize and/or electrostatically charge material and to produce a desired spray pattern. The spray nozzle assembly typically includes a nozzle holder or adapter and a nozzle tip or orifice. The assembly may include other parts such as seals for example. The assembly is typically mounted on the spray end of a gun or dispenser using a retaining nut or other suitable device.

Some objects, for example, single open ended cans, require a controlled or directional spray pattern to optimize application of material to the surface of interest. A controlled spray pattern is any spray pattern that is produced with a non-uniform distribution of material about the central axis of the nozzle tip. Controlled spray patterns are needed in many applications in which it is desired to direct material in a particular manner at the surface being coated. One example of a controlled spray pattern is a directional spray pattern which is simply a spray pattern in which the material exits the nozzle tip in an asymmetrical pattern relative to the central axis of the nozzle tip. An asymmetrical pattern is a spray pattern that has a shape that is heavier on one side or skewed to one side with respect to the central axis of the nozzle tip. Controlled and directional spray patterns and the nozzle designs to produce them are well known in the art.

Because a controlled spray pattern is intentionally asymmetrical about the central axis of the nozzle and/or gun, it is often necessary for the operator to know the alignment of the nozzle prior to starting a spray operation. Typically this is achieved by the nozzle adapter having a marking or indicia thereon that visually indicates to the operator the heavy side of the spray nozzle. In some cases, shallow grooves have been provided for visual indication of the spray pattern orientation. These indicia, however, can be very small (such as about 0.125 inch) and can be difficult to see and can even become obscured by overspray of material onto the nozzle adapter.

SUMMARY OF THE INVENTION

The invention contemplates in one aspect an arrangement by which an operator can easily verify or identify the orientation of a nozzle, and more specifically the orientation of an asymmetrical spray pattern produced by the nozzle. In one embodiment, a nozzle tip holder or adapter is provided that includes one or more features that allows an operator to quickly identify the orientation of the nozzle spray pattern. In an exemplary embodiment the nozzle tip holder includes a keyway like structure such as recesses, notches, holes or similar features that indicate the pattern orientation. The nozzle tip is firmly inserted in or otherwise assembled with the nozzle tip holder with a known orientation relative to the structure so that the operator need only look at the adapter keyway and not have to visually perceive from the nozzle tip the spray pattern orientation. This aspect of the invention may be used with an integral nozzle that produces an asymmetrical tip but does not have a separately inserted nozzle tip.

In accordance with another aspect of the invention, an arrangement is contemplated that allows for simple adjustment of a nozzle tip holder to adjust the orientation or position of the spray pattern. The nozzle tip holder is assembled to the gun in a manner that allows the angular orientation of the holder to be easily changed. In one embodiment, the nozzle tip holder further includes a structural feature such as a keyway that allows a tool to be used to change the angular orientation of the nozzle assembly to select a desired orientation of the spray pattern relative to an axis of the gun. Optionally, a visual indication to the operator of the spray pattern orientation may be provided as noted hereinabove. This allows the operator to adjust the spray pattern orientation prior to beginning a spraying operation. The visual indication can be included as part of the tool, on the nozzle tip holder or both as required. In a particular embodiment, the nozzle tip holder includes a structural feature such as a keyway that both allows a tool to be used to change the angular orientation of the spray pattern as well as provide a visual indication to the operator of that orientation. In another embodiment, the tool can be used to hold the nozzle tip holder in a desired orientation as the holder is being assembled securely to the gun.

In accordance with another aspect of the invention, an arrangement is contemplated by which a nozzle tip can be retained at a desired angle or offset relative to an axis of the gun. In one embodiment, a nozzle tip holder is provided that includes an angled recess that receives the nozzle tip. The invention further contemplates a process for coating a can that includes use of such a tilted nozzle tip. Still further, the invention contemplates an arrangement that includes the use of a tilted nozzle tip and an asymmetrical spray pattern, and in another embodiment in combination with an arrangement such as for example a keyway and tool as set forth above.

These and other aspects and advantages of the present invention will be appreciated and understood by those skilled in the art from the following detailed description of the exemplary embodiments in view of the accompanying drawings.

DETAILED DESCRIPTION OF THE EXEMPLARY EMBODIMENTS

Figure 1:
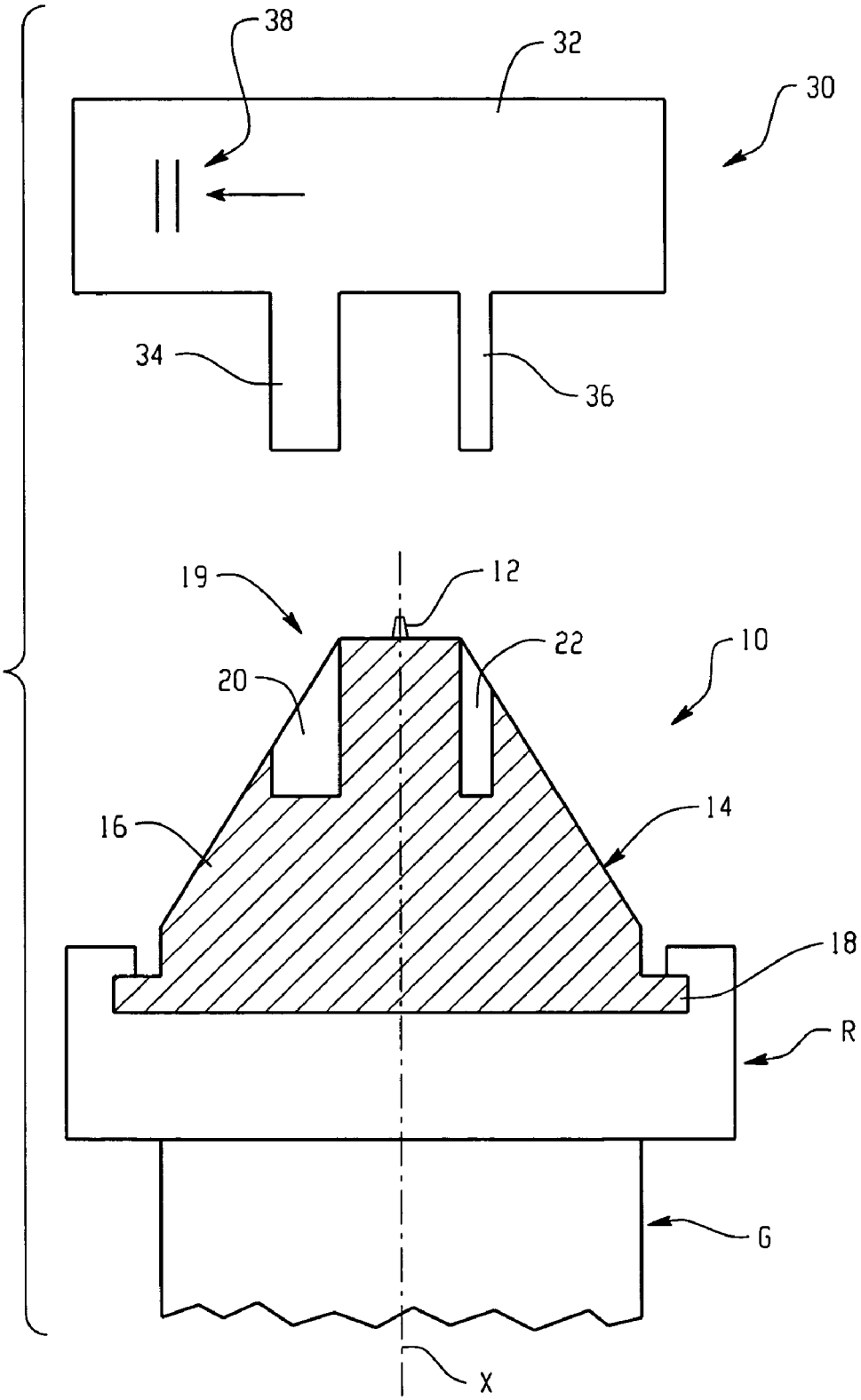
FIG. 1 illustrates a nozzle assembly that includes a nozzle tip and a nozzle holder in partial cross-section, along with an alignment tool, in accordance with the invention.

With reference to FIG. 1, a spray nozzle assembly 10 in accordance with an exemplary embodiment of the invention is illustrated. The assembly 10 may be used with any spray gun, applicator or dispenser or similar device G to which it can be attached or mounted or assembled. The device G typically will include a retainer R or similarly functioning device that can hold the assembly 10 on the device G in such a manner that the assembly can be rotated about the central axis X of the nozzle, for example, before the retainer is fully tightened. The device G and retainer R are illustrated schematically for clarity. The retainer may be loosened for adjustment of the orientation of the spray pattern then re-tightened as required. Examples of devices that can use the present invention are described in the following United States patents which are fully incorporated herein by reference, however, the invention may be used with any spray type device, applicator, or dispensing type device G: U.S. Pat. Nos. 3,697,313; 3,737,108; 3,819,403; 5,078,325; 5,494,226; 5,941,463; and 6,742,730. The device G may be electrostatic or non-electrostatic, and used for liquid, powder or other materials that are applied with a controlled spray pattern. As used herein, nozzle tip and orifice are used interchangeably and refer to a device having an orifice formed therein through which material exits in a controlled asymmetrical pattern. As used herein, nozzle tip holder and nozzle tip adapter are used interchangeably to refer to a device that holds a nozzle tip and is used to mount the nozzle tip onto a spray gun or dispenser or other suitable device.

While various aspects of the invention are described and illustrated herein as embodied in combination in the exemplary embodiments, these various aspects may be realized in many alternative embodiments, either individually or in various combinations and sub-combinations thereof. Unless expressly excluded herein all such combinations and sub-combinations are intended to be within the scope of the present invention. Still further, while various alternative embodiments as to the various aspects and features of the invention, such as alternative materials, structures, configurations, methods, devices, software, hardware, control logic and so on may be described herein, such descriptions are not intended to be a complete or exhaustive list of available alternative embodiments, whether presently known or later developed. Those skilled in the art may readily adopt one or more of the aspects, concepts or features of the invention into additional embodiments within the scope of the present invention even if such embodiments are not expressly disclosed herein. Additionally, even though some features, concepts or aspects of the invention may be described herein as being a preferred arrangement or method, such description is not intended to suggest that such feature is required or necessary unless expressly so stated. Still further, exemplary or representative values and ranges may be included to assist in understanding the present invention however, such values and ranges are not to be construed in a limiting sense and are intended to be critical values or ranges only if so expressly stated. Additionally, even though some features and aspects and combinations thereof may be described or illustrated herein as having a specific form, fit, function, arrangement or method, such description is not intended to suggest that such descriptions or illustrated arrangements are required or necessary unless so expressly stated. Those skilled in the art will readily appreciate additional and alternative form, function, arrangement or methods that are either known or later developed as substitute or alternatives for the embodiments described herein.

With continued reference then to FIG. 1, the nozzle assembly 10 includes a nozzle tip 12 and a nozzle tip holder 14. The nozzle tip 12 is only partially shown in this drawing, and may be retained in the holder 14 by any suitable technique including brazing, press fit and so on, some of which are fully described in the above referenced patents. The particular way that the tip 12 is secured to the holder 14 forms no particular part of the present invention, but it is contemplated that the relative positional relationship or orientation between the tip 12 and the holder 14 is fixed prior to or after final installation into a device G. In other words, the tip 12 is installed into the holder 14 with a known orientation corresponding to a desired orientation of the spray pattern produced by the nozzle tip.

The holder 14 includes a body 16 that typically but not necessarily has a conical configuration. The back end of the holder 14 may include a lip or flange or other suitable structure 18 that can be used to secure the holder 14 to the device G such as with the retainer R, while optionally allowing for rotation of the holder 14 about the central axis X when the retainer R is loosely installed. The nut retainer R may be designed so that it can be slightly loosened to permit this adjustment or rotation of the nozzle assembly 10, and then re-tightened to firmly hold the nozzle assembly 10 in position during a spraying operation.

The nozzle holder 14 includes one or more structural features 19 that may be used to indicate to an operator the orientation of the assembly 10, and most notably the orientation of the asymmetrical spray pattern produced by the nozzle tip 12. In this exemplary embodiment, the structural feature is realized in the form of a keyway comprising two blind holes 20, 22 that are different relative to each other. For example, the first hole 20 may be noticeably larger in diameter than the second hole 22. When the nozzle tip 12 is installed into the nozzle holder 14, it is oriented so that the heavy side of the spray pattern is aligned with the larger hole 20. Thus, the larger hole 20 in and of itself may be used to indicate to the operator the side that the heavier portion of the spray pattern will be produced. In an alternative embodiment the holes 20, 22 may have different shapes or may instead be raised protrusions that convey similar information.

The nozzle holder 14 thus is provided with a structural feature or features that visually or otherwise indicate to the operator the spray pattern orientation. This aspect of the invention can be used whether the orientation of the nozzle holder 14 can be adjusted or not after installation on the device G.

In accordance with another aspect of the invention, the structural feature 19 may also be realized in the form of or function as a keyway or mechanical interface to cooperate with a tool such as a key 30. The key 30 may be used to adjust the orientation of the nozzle holder 14 and thus the spray pattern when the retainer R is not fully tightened. Moreover, the key 30 at anytime may be inserted into the keyway 19 to provide a more easily viewed representation of the spray pattern orientation, rather than the operator having to discern the two holes 20, 22. Still further, the key 30 may be used to hold the nozzle holder 14 aligned properly as the retainer R is being tightened.

In one embodiment, the tool 30 includes a suitable handle or grip 32 that can be grasped by an operator and two legs 34, 36 that conform to the size and shape of the keyway holes 20, 22. When the legs 34, 36 are inserted into the holes 20, 22, the tool 30 may be used to easily rotate the nozzle holder 14, thus adjusting or positioning the nozzle tip 12 to orient the spray pattern as needed. The holes 20, 22 thus can be used not only to indicate the orientation of the spray pattern but also to allow adjustment thereof. If instead of holes the feature 19 is realized in the form of protrusions or extensions from the nozzle holder 14, then the tool 30 could include corresponding holes or recesses or other conforming shape. Many other alternative embodiments will be readily apparent to those skilled in the art that would allow rotational adjustment of the nozzle holder 14 with a key-like tool and optionally also indicate the spray pattern orientation either by the keyway, the tool or both.

The tool 30 may also optionally be provided with indicia 38 or other feature that indicates visually or otherwise to the operator the spray pattern orientation. The tool 30 typically will be used only during non-spraying operations and will be stored during a spraying operation and therefore the indicia 38 is not likely to become obscured from overspray. This feature also allows the operator to see and verify the new orientation while actually using the tool, during which time the holes 20, 22 may not be readily visible or discernible.

In accordance then with alternative forms of the invention but not intending to be an exhaustive list of all such alternatives, a nozzle holder may include a keyway type feature that indicates a characteristic of the nozzle spray pattern such as shape or orientation. This indication can be used during or after installation of the nozzle holder in a gun. Alternatively, the nozzle holder feature may also be engaged by a key or tool to adjust the orientation of the nozzle holder relative to an axis of rotation. The tool may optionally include indicia of the orientation. Another alternative is that the nozzle holder may include a feature that can be engaged by a tool for rotating the nozzle holder to a desired orientation wherein the tool includes a feature that indicates the orientation of the spray pattern.

Figure 2:
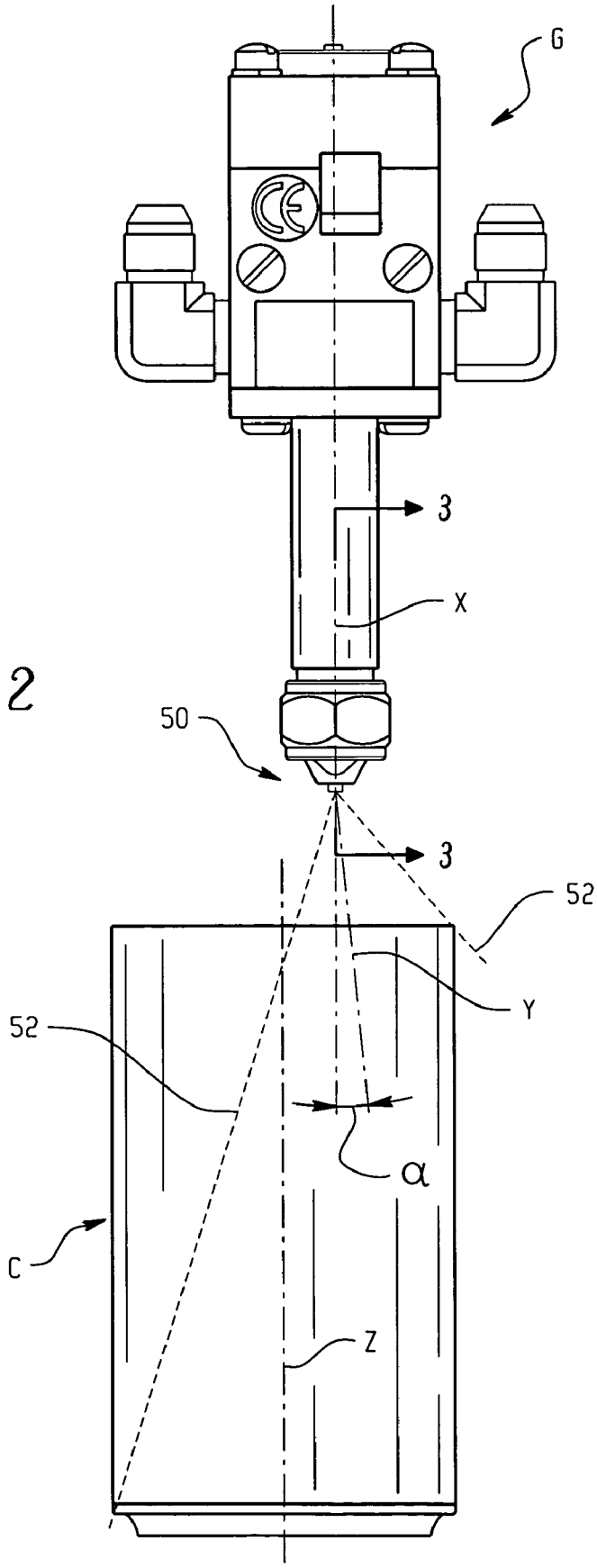
FIG. 2 is a spray applicator illustrated in a typical configuration for spraying a can, using various aspects of the invention.
Figure 3:
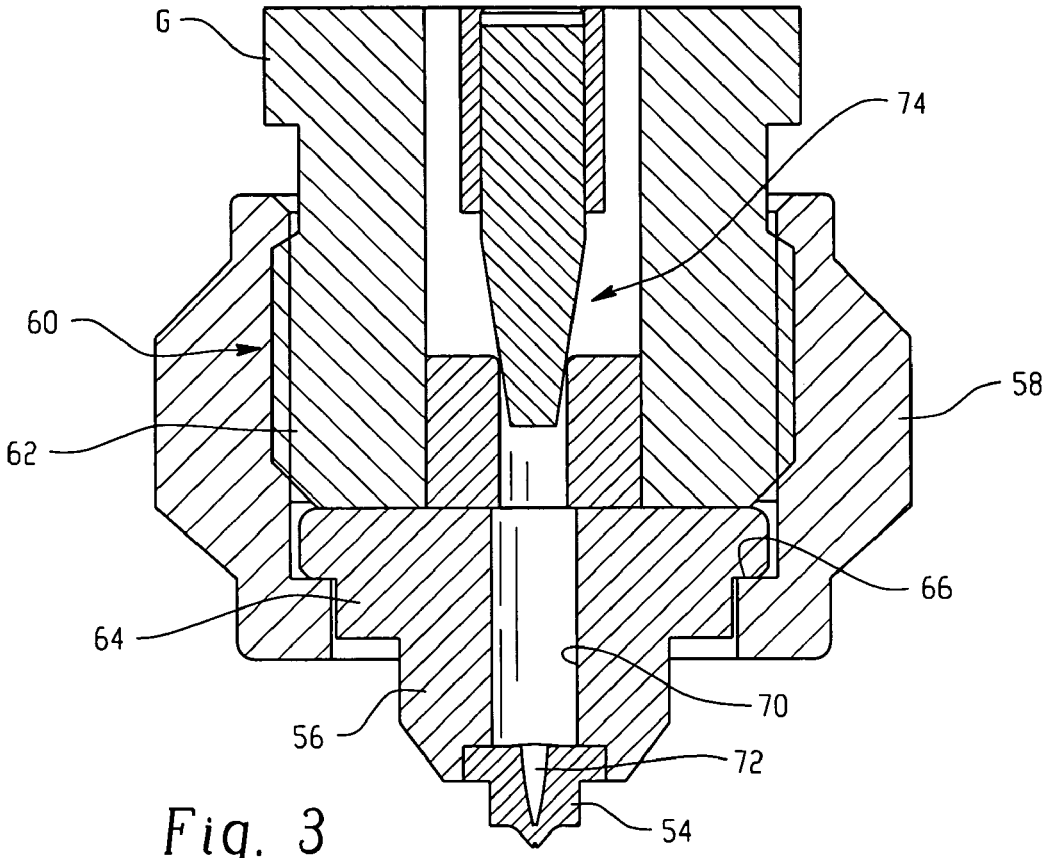
FIG. 3 is a cross-section along the line 3-3 in FIG. 2.
Figure 4:
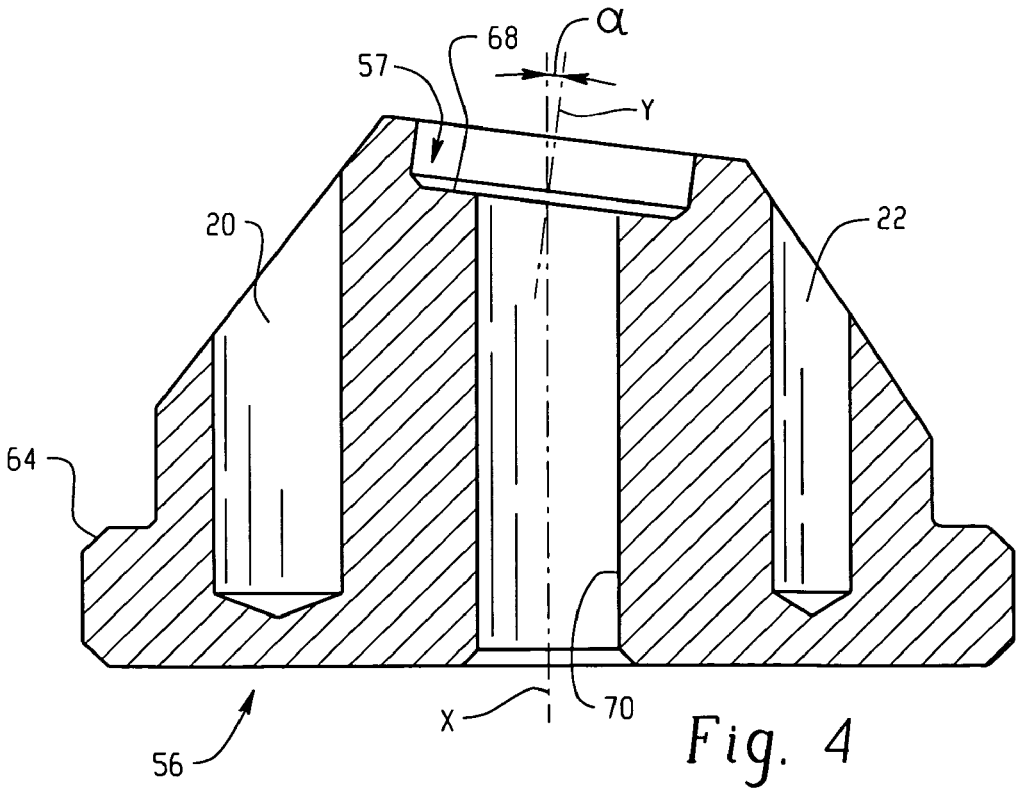
FIG. 4 is an enlarged cross-section of a nozzle tip holder.

FIGS. 2-4 illustrate another aspect of the invention. As generally shown in the drawing, a gun or other spray device G is provided so as to spray the inside of a single ended open can C. The gun G has a longitudinal reference axis X and includes a nozzle assembly 50 at the spray end thereof. In accordance with another aspect of the invention, the nozzle assembly 50 is arranged so as to produce a spray pattern that is generally directed along an axis Y, wherein the axis Y is offset from the axis X by an angle $\alpha$. Thus the nozzle assembly is tilted in the sense that it does not spray along an axis that is coaxial with the longitudinal axis of the gun. In the exemplary embodiment the angle $\alpha$ may be about six degrees, however, other angles may be used as required for a particular spraying operation. The gun G may optionally be laterally offset from the center longitudinal axis Z of the can C. The angle $\alpha$ may be selected so that an optimized orientation of the spray pattern 52 from the nozzle 50 is used to apply material to the can interior surfaces. The tilted nozzle assembly 50 thus allows an optimized spray angle into the can C while allowing the gun G to approach the can on axis, in other words with the X and Z axes generally parallel.

With reference to FIGS. 3 and 4, the nozzle assembly 50 includes a nozzle tip 54 that is retained in a nozzle holder or adapter 56. The nozzle holder 56 includes a recess 57 such as a counterbore that is formed or tilted at the angle $\alpha$ along the axis Y relative to the centerline X thereof. The nozzle holder 56 is retained on the gun G by a nut 58, such as by a threaded engagement 60 between the nut 58 and the gun end 62. The nozzle holder 56 includes a flange 64 that is engaged by a lip 66 on the nut 58 in order to tighten the nozzle assembly 50 onto the gun G.

The recess 57 includes a seat portion 68 against which the nozzle tip 54 sits. As in the above described embodiment, the tip 54 can be inserted by brazing, press-fit or other suitable means. The recess 57 is in fluid communication with a central bore 70 through the nozzle adapter 56. The nozzle tip also includes a flow passage 72 that is in fluid communication with the nozzle adapter bore 70. The nozzle adapter bore 70 opens to a flow control valve assembly 74 inside the gun end.

The tilted nozzle concept may be used with an orifice that produces a symmetrical or asymmetrical spray pattern. When an asymmetrical spray pattern is used, the nozzle holder 56 may include the keyway concept 19 described hereinabove, such as with holes 20, 22. By comparing FIGS. 1 and 4, it will be noted that when the tilted nozzle concept is incorporated into the nozzle holder 56, the keyway 19 may be formed radially outward from the tilted recess 57.

Figure 5A:
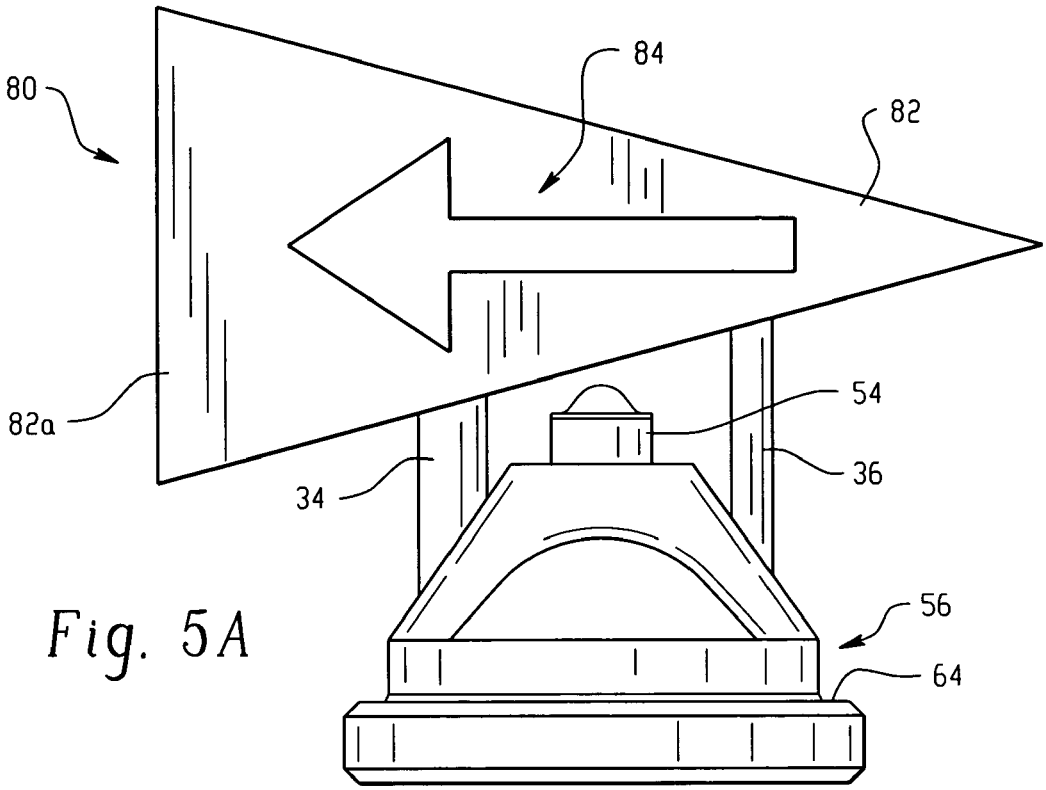
FIGS. 5A and 5B illustrate in elevation and cross-section another embodiment of a key or tool in accordance with the invention.
Figure 5B:
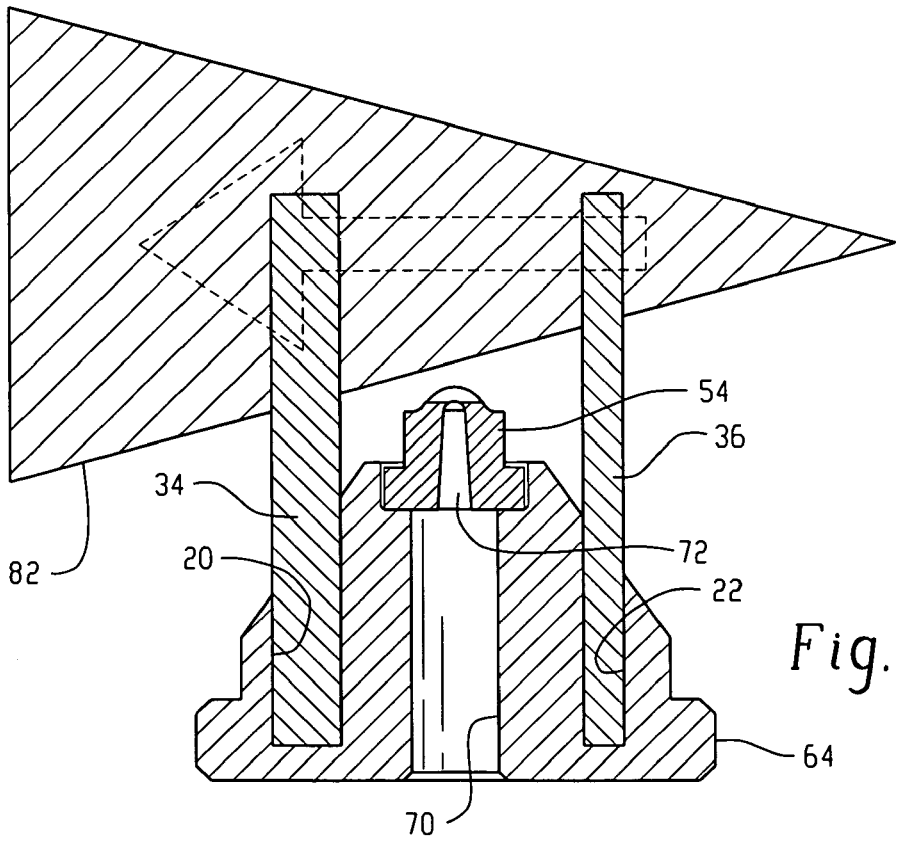

With reference to FIGS. 5A and 5B, another embodiment of the key concept is illustrated in elevation and partial cross-section. The key 80 in this case includes a handle 82 that may include an indicia 84 showing the direction of the heavy portion of the spray pattern. The handle 82 may also have a geometric shape that also provides a visual indication of the pattern distribution. In this example the handle has one end 82*a* that is wider on the heavy pattern side.

The invention has been described with reference to the preferred embodiment. Modifications and alterations will occur to others upon a reading and understanding of this specification. It is intended to include all such modifications and alterations insofar as they come within the scope of the appended claims or the equivalents thereof.

We claim:

1. A spray nozzle assembly for a spray gun, comprising a nozzle tip fixedly secured in a nozzle holder, said nozzle holder having a body with a keyway formed in said body, said keyway indicating a characteristic of the spray pattern produced by said nozzle tip, said nozzle tip being fixedly secured in said nozzle holder with a predetermined orientation relative to said keyway, a key that can engage said keyway to rotate said nozzle holder together with said nozzle tip, said key being disengaged from said keyway during a spraying operation.

2. The assembly of claim 1 wherein said characteristic is the shape of the spray pattern.

3. The assembly of claim 1 wherein said key is engaged with said keyway to rotate said nozzle holder or to hold said nozzle holder against rotation.

4. The assembly of claim 1 wherein said keyway comprises two openings formed in said nozzle holder body.

5. The assembly of claim 1 wherein said nozzle tip produces an asymmetrical spray pattern.

6. The assembly of claim 5 wherein said keyway comprises two or more holes formed in said nozzle holder body.

7. The assembly of claim 5 wherein said key has a shape that provides an indication of said spray pattern shape.

8. The assembly of claim 7 wherein said key indicates visually a heavy side of said spray pattern.

9. The assembly of claim 1 wherein said nozzle holder body comprises a recess adapted to receive and retain said nozzle tip therein, said nozzle holder body having a central longitudinal axis, said recess being formed so that said nozzle tip is oriented at an angle relative to said longitudinal axis.

10. Apparatus comprising: a spray nozzle having a nozzle holder and a nozzle tip fixedly secured in said nozzle holder, said nozzle tip producing a spray pattern during a spraying operation, said nozzle holder having a keyway, and a key that can be selectively engaged with said keyway to rotate said nozzle holder together with said nozzle tip, said key being disengaged from said spray nozzle during a spraying operation.

11. The apparatus of claim 10 wherein said keyway comprises at least two holes formed in said body wherein said holes are of different appearance.

12. The apparatus of claim 11 wherein said different appearance is different size.

13. The apparatus of claim 12 wherein said different appearance is either or both of different shape and different size.

14. The apparatus of claim 11 wherein said key has members that operatively engage said holes so that the key can be used to rotate said nozzle holder to a desired orientation.

15. The apparatus of claim 10 wherein said key comprises a visually observable feature that indicates a characteristic of a spray pattern produced by the nozzle tip when in use during a spray operation.

16. The apparatus of claim 10 wherein said key comprises a handle having a shape that indicates a characteristic and orientation of an asymmetrical spray pattern.

17. The apparatus of claim 16 wherein said characteristic of said asymmetrical spray pattern is distribution of material within the spray pattern.

18. The combination of a nozzle assembly and a manual tool, comprising:

said nozzle assembly comprising a nozzle holder and a nozzle tip, said nozzle tip being retained in said nozzle holder in a fixed relationship to said nozzle holder, said nozzle tip producing an asymmetric spray pattern relative to an axis, said nozzle holder comprising a body having a feature that is selectively engaged with and disengaged from the tool, and said tool comprising a visual indication that indicates orientation of said spray pattern, said tool being disengaged from said nozzle holder during a spraying operation.

19. The combination of claim 18 wherein the tool comprises indicia that indicates a characteristic of said spray pattern.

20. The combination of claim 18 wherein said tool comprises a handle having a shape that indicates a characteristic and orientation of said asymmetrical spray pattern.

21. The combination of claim 18 wherein said tool can be used to change the orientation of said spray pattern and to restrict rotation of said nozzle holder.

22. The combination of claim 18 wherein said nozzle holder has a central longitudinal axis and retains said nozzle tip at an angle relative to said axis.

23. Apparatus comprising: a spray nozzle having a body with a nozzle tip that produces a spray pattern, said body having a keyway, and a key that can be selectively engaged with and disengaged from said keyway, said key comprises a handle having a shape that indicates a characteristic and orientation of an asymmetrical spray pattern.

* * * * *